United States Patent [19]

Schmermund

[11] 4,042,094

[45] Aug. 16, 1977

[54] CONVEYING AND STORING APPARATUS

[76] Inventor: Alfred Schmermund, Kornerstrasse 62, 5820 Gevelsberg, Germany

[21] Appl. No.: 689,411

[22] Filed: May 24, 1977

[51] Int. Cl.[2] ..... B65G 43/08; C10B 31/04

[52] U.S. Cl. ..... 198/347; 214/17 CA; 214/17 DA; 131/25

[58] Field of Search ..... 214/17 CA, 17 DB, 17 DA; 53/59 R, 148, 236; 131/25; 198/347

[56] References Cited

U.S. PATENT DOCUMENTS

| | | | |
|---|---|---|---|
| 1,885,892 | 11/1932 | Bronander | 131/25 X |
| 2,330,000 | 9/1943 | Molins | 131/25 |
| 2,791,887 | 5/1957 | Hennig | 214/17 DB |
| 3,147,846 | 9/1964 | Huntoon | 214/17 CA |
| 3,923,146 | 12/1975 | Hall | 198/347 |

*Primary Examiner*—Albert J. Makay
*Attorney, Agent, or Firm*—Sughrue, Rothwell, Mion, Zinn and Macpeak

[57] ABSTRACT

There is disclosed conveying and storing apparatus for conveying articles, in particular cigarettes, between two machines and for storing articles in transit between the machines. The apparatus comprises a conveyor with a pivotable carrier member, two rotatable pulleys mounted on the carrier member respectively upstream and downstream in the direction of conveying by the conveyor, and a conveyor belt extending around the pulleys, the carrier member being pivotable about the axis of rotation of the downstream pulley. The apparatus further comprises means to define with the conveyor a store for storing articles, such means including an arcuate wall located at the upstream end of the conveyor and extending parallel to the path described by that end of the conveyor when the carrier member is pivoted. The carrier member can be pivoted upwardly to decrease the volume of the store so as to maintain delivery of the articles when the upstream machine is stopped, or downwardly to increase the volume of the store so as to store the articles when the downstream machine is stopped.

8 Claims, 5 Drawing Figures

CONVEYING AND STORING APPARATUS

BACKGROUND OF THE INVENTION

The present invention relates to conveying and storing apparatus for conveying articles between two machines and for storing articles in transit between the machines, in particular for conveying and storing cigarettes between a filter web machine and a cigarette packing machine.

It is becoming increasingly usual to connect a cigarette packing machine directly with a cigarette strand machine or filter application machine in order to restrict the operation to fewer personnel and to save on the number of transport containers required. Accordingly, the cigarettes, lying transversely, are fed directly from one machine to the next on a simple conveying belt, on which a smoothing belt can still loosely rest. This leads to difficulties, however, when one of the machines has a stoppage. If the package machine stops, then the problem arises of disposing of cigarettes supplied at a rate of, for example, 4000 to 6000 per minute. If the filter web machine stops, then the problem arises of finding an alternative supply of cigarettes. In this connection, there are known feed devices of a complicated kind, which serve for the loading of several packing machines disposed at a spacing from one another and which are controllable to increase or reduce the stacking height of cigarettes on the feed belts. However, as several groups each of a smaller number of machines, for example a packing machine and one or two stranding or filter applying machines, are preferable, because they are more easily monitored and can individually be subject to a stoppage, feed devices of the above-mentioned kind cannot be employed.

It is therefore the object of the present invention to provide conveying and storing apparaus which can for a short time serve to store articles in transit between two machines and which is constructed as simply as possible.

SUMMARY OF THE INVENTION

According to the present invention there is provided conveying and storing apparatus for conveying articles between two machines and for storing articles in transit between the machines, comprising a conveyor to convey the articles in a conveying direction, the conveyor comprising a pivotable carrier member, two pulleys mounted on the member respectively upstream and downstream in the conveying direction and rotatable about respective axes of rotation, and a conveyor belt extending around the pulleys, the carrier member being pivotable about the axis of rotation of the downstream one of the pulleys, and store defining means to define with the conveyor a store for storing the articles, the store defining means comprising an arcuate wall element, which is arranged adjacent to the conveyor belt at the upstream end of the conveyor and which extends parallel to the path described by the upstream end of the conveyor under pivoting of the carrier member.

With this arrangement, the conveyor belt can be moved downwardly along the arcuate well member on pivoting of the carrier member, so that between the wall element, the conveyor belt and a plane connecting the input and output points for the articles, there is defined a storage space, which is of sectoral shape in the plane of movement of the carrier member and which serves for the reception and storage of cigarettes supplied to the apparatus.

Expediently, the belt is provided with a plurality of entraining members to ensure transport of the articles even when the conveyor is in an inclined position, so that none of the articles remains for an undue period of time in the store, which in the case where the articles are cigarettes, could result in damage or deterioration of the cigarettes.

Preferably, the conveyor belt and each of the pulleys are of divided construction and the carrier member is disposed between the divided portions thereof, so as to avoid gaps between side walls of the store in the vicinity of the upstream one of the pulleys and thereby to prevent articles from falling off the conveyor. In addition, a tensioning roller, of divided construction if appropriate, can be provided for tensioning the conveyor belt. The entraining members may also be of divided construction, and the arcuate wall member can be provided with recesses receiving the divided portions of the entraining members. By this means, wedging of the articles between the arcuate wall member and the conveyor belt can be avoided.

For preference, the carrier member is pivotable between a first setting in which the conveyor is horizontal, a second setting in which the conveyor is downwardly inclined at a first angle, and a third setting in which the conveyor is downwardly inclined at a second angle equal to twice the first angle. The second setting can in this case be utilised as the normal operating setting, so as to provide a storage capacity which can be increased or reduced as may be required. For a further increase in the storage capacity, additional conveyors and store defining means respectively associated therewith can be arranged in series downstream of the conveying direction.

A guide element, which can be provided with recesses for the entraining members of the conveyor belt, can be arranged above the upstream one of the pulleys to guide articles onto the conveyor belt from a feed belt.

Conveniently, the apparatus comprises a first drive means to drive the conveyor belt, a second drive means to pivot the carrier member, and control means to control the first and second drive means in dependence on the operating states of a machine supplying the articles to the apparatus and a machine receiving the articles from the apparatus.

BRIEF DESCRIPTION OF THE DRAWINGS

An embodiment of the present invention will now be more particularly described by way of example with reference to the accompanying drawings, in which.

DESCRIPTION OF THE PREFERRED EMBODIMENT

Figure 1:
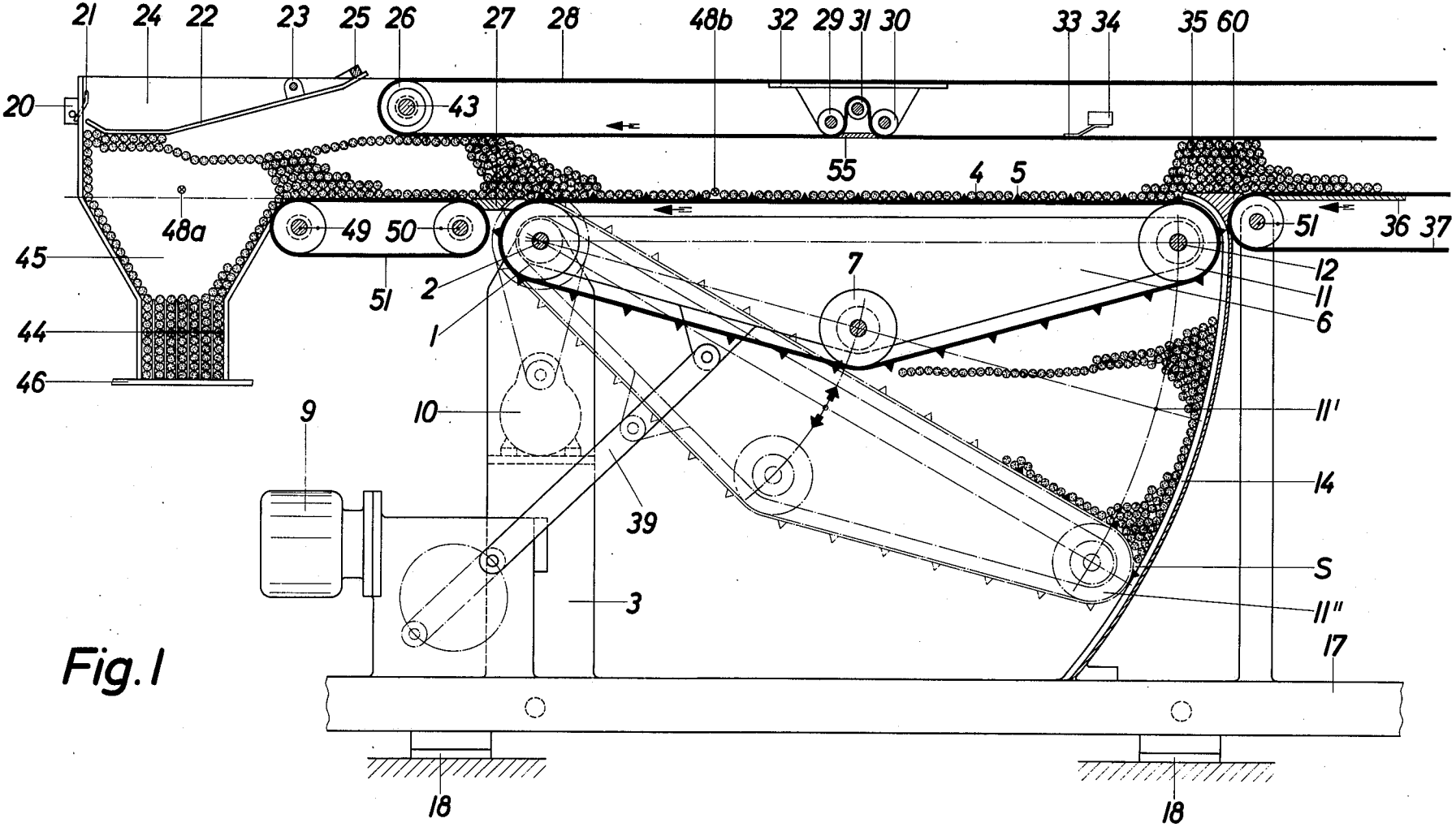
FIG. 1 is a schematic side elevation of conveying and storing apparatus according to the invention.

Referring now to the drawings, there is shown apparatus for conveying and storing cigarettes, the apparatus comprising a conveyor having a conveyor belt 4 extending around a belt pulley 1 which is downstream in the diretion of conveying of the cigarettes, an upstream belt pulley 11, and a lower belt pulley 7 serving as a tensioning pulley. The belt 4 and the belt pulleys 1, 7 and 11 are of divided construction and are mounted on a carrier member 6 arranged between the divided portions of the belt and pulleys, the pulleys 1 and 11 being respectively mounted on two axles 2 and 12. The carrier 6 is arranged to be pivotable about the axle 2, which is journalled in the upper part of a machine frame comprising vertical members 3 and 47, horizontal members 16, base members 17, feet 18 and tie rods 42.

The belt pulley 1 is driven by a motor 10 via a drive belt extending around a drive pulley on the axle 2.

The carrier member 6 is pivotable about the axle 2 of the belt pulley 1 by means of a motor 9 which drives a wheel 41 having pivotably and eccentrically connected thereto a sleeve 40 at one end of a forked arm 39, the other end of the arm 39 being pivotably connected to the carrier member 6.

Arranged in the machine frame are store side walls 13 on both sides of the belt 4, and a back wall 14 in the form of a metal plate, which is bent into a circularly arcuate shape and along which the downstream end of the belt 4 moves when the carrier member 6 is pivoted. The carrier member 6 can be pivoted through angles of, for example, 15°, 30°, 45° and 60°, or even more, to define with the side walls 13 and the back wall 14 a store having a volume which is increased as the angle of pivoting is increased. To ensure that a quantity of cigarettes does not remain in the store when the carrier member 6 is pivoted downwardly, the belt 4 is provided over its entire length with a plurality of substantially triangular section entraining members 5, which are arranged at a spacing from one another and which are approximately the same size as a cigarette. Accordingly, any cigarettes lying on the belt 4 in the lower part of the store are conveyed out of the store even when the conveyor is inclined.

To avoid wedging of cigarettes between the belt 4 and the back wall 14, the entraining members 5 on each divided portion of the belt 4 are themselves divided, and the back wall 14 is provided over its entire length and on its side facing the belt 4 with recesses 15 into which the entraining members 5 project, so as to avoid any gap between the entraining members 5 and the back wall 14.

The side walls 13 project beyond the belt 4 in such a manner as to form a channel above the belt 4, and extend downwardly to such an extent that the belt 4 remains between the side walls in the lowermost setting of the conveyor. To avoid the presence of a gap, through which the cigarettes could fall, between the side walls 13 and the conveyor in the region of the axle 12 of the pulley 11, the carrier member 6 is, as already explained, arranged centrally between the divided belt 4 and belt pulleys. Arranged upstream of the belt 4 is a feed belt 37 guided around a pulley 51, and arranged above the belts 4 an 37 is a level control belt 28 serving to ensure that the cigarettes are evenly distributed over the belts 4 and 37. The belt 28 is relatively long compared to the belt 4 and is guided at each end around a roller 26 mounted on a shaft 43 attached to one of the machine frame members 47 and intermediate its ends around tensioning rollers 29, 30 and 31, the latter rollers being provided to reduce the degree of droop of the belt 28, i.e. by about half. Nevertheless, the belt 28 should still have some degree of droop. The space between the tensioning rollers 29 and 30 is closed by a cover member 55, so as to prevent cigarettes from entering this space. The tensioning rollers are mounted on a rail 32, which also serves to support the upper run of the belt 28 above the rollers.

A control switch 34 with a contact maker 33, which is operated when too many cigarettes 35 collect on the belt 4, is arranged above the lower run of the belt 28. The switch 34 can be connected to reduce the operating speed of the machine upstream of the belt 4, for example a filter strand machine, or increase that of the machine downstream of the belt 4, for example a packing machine.

Between the upstream end of the belt 4 and the wall 14 there is defined a space S, and to prevent cigarettes from remaining for an undue period of time in this space when the carrier member 6 is in a downwardly pvioted position, the entraining members 5 on the belt 4 project into the recesses 15 in the wall 14. To provide a smooth transition when the carrier member 6 is pivoted up into an upper setting in which the upper run of the belt 4 is horizontal, i.e. the position shown in solid lines in FIG. 1, a guide element 60, which is also provided with recesses for the entraining members 5, is arranged above the pulley 11 and between the pulley 11 and the pulley 51 for the feed belt 37. The guide element 60 ensures that all the cigarettes are removed from the store and conveyed on to the packing machine, when the carrier member 6 is pivoted into its upper setting. From the belt 4, the conveyed cigarettes are guided over an intermediate member 27 to a further conveyor belt 51, which extends around rollers 49 and 50 and which conveys the cigarettes to a supply funnel 45 of the packing machine, the supply funnel having internal partition walls 44 to separate the cigarettes into streams. Disposed above the funnel 44 and ahead of an end wall thereof is a level monitor in the form of a metal plate 22, which is pivotable about an axle 23 and which comprises a shorter arm adapted to bear on an abutment 25 and a longer arm having a bent over end portion adapted to actuate contacts 21 of a switch 20 when the plate 22 is pivoted by a build up of cigarettes in the funnel area. The switch 20 is connected to influence the operating speed of either the filter strand machine or the packing machine, whereby overfilling of the funnel can be prevented.

The belt 4 normally always runs at a speed corresponding to the operating speed of the packing machine, being driven by the motor 10, if required, by way of suitable gearing. The motor 10 can be a geared motor.

If insufficient cigarettes for the packing machine are conveyed by the belt 4, the operating speed of the packing machine is appropriately reduced by means of a level control monitor **48*a* in the funnel 45. If too many cigarettes are conveyed, the motor 9 is set into operation and the carrier member 6 with the belt 4 is pivoted downwardly into an intermediate setting 11' or a lower setting 11''**. In the intermediate setting, the operating speed of the filter strand machine is reduced until equilibrium is present or the operating speed of the packing machine is increased. Control in these circumstances can be effected by way of, for example, a displacement meter, which can be in the form of, of example, a potentiometer or slider resistance. The regulation can be carried out electronically.

In the foregoing, the normal mode of operation exists when the cigarettes are conveyed by the belt 4 with the carrier member 6 in its upper setting. It is advantageous, however, to select the intermediate setting as the normal operating state, rather than the upper setting. In this case, cigarettes are always conveyed upwardly by the belt 4, including those cigarettes in the lowermost part of the store, due to the action of the entraining members 5 on the belt. Since the belt 4 is operating at the base of the store and the store is gradually filled with cigarettes fed by the belt 37, movement of the cigarettes takes place from above and below.

If the packing machine is stopped for a short period of time, the carrier member 6 is lowered into its lower setting 11″ to increase the volume of the store. Conversely, if the filter strand machine is stopped, the carrier member 6 is moved upwardly into its upper setting and the store is emptied.

If the spacing between the belt pulleys 1 and 12 is, for example, and 2 meters and the carrier member is pivotable downwardly through a maximum of 45°, then a store side area of about 2 square meters is provided. As a cigarette has a diameter of approximately 8 millimeters, the store can thus accept roughly 30,000 cigarettes. Since on cigarette pack contains 20 cigarettes and the packing machine may operate to deliver, for example, 300 packs per minute, this would provide a store filling time of $30{,}000 \div 20 \times 300 = 5$ minutes. Proceeding from the intermediate setting of the carrier member 6, the store would be able to exclusively deliver or exclusively receive for 2½ minutes.

It is possible to arrange two or more additional conveyors and stores in series downstream of the belt 4 to increase the total available storage capacity, and to operate the additional conveyors and stores either in like manner or else one for reception of cigarettes and on for delivery of cigarettes.

A quantity of 30,000 cigarettes weighs about 30 kilograms, which can easily be managed by the carrier member in a conveyor having the dimensions mentioned above.

Irrespective of which setting the carrier member 6 is in, the level of cigarettes present should always be above a horizontal plane containing the upper run of the belt 51, the cigarettes in the funnel 45 being maintained above this plans by the level monitor 48*a*. If the level of cigarettes present falls below this plane, the carrier member 6 is pivoted upwardly into its uppermost setting, and if in this setting the level of cigarettes again falls below this plane, the packing machine is stopped until the filter strand machine delivers a sufficient volume of cigarettes.

The level control monitor 48*a* can be in the form of, for example, a photoelectric cell or a pneumatic element.

Figure 5:
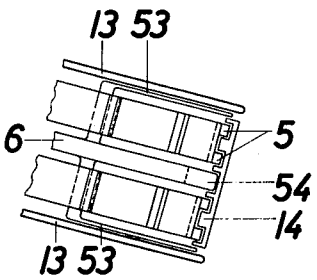
FIG. 5 is a plan view of the detail of FIG. 4.
Figure 4:
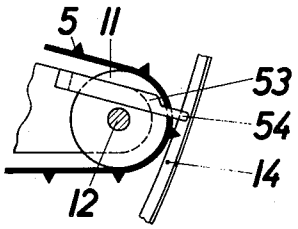
FIG. 4 is a detail, in side elevation, of the downstream end of the conveyor of the apparatus of FIG. 1.
Figure 3:
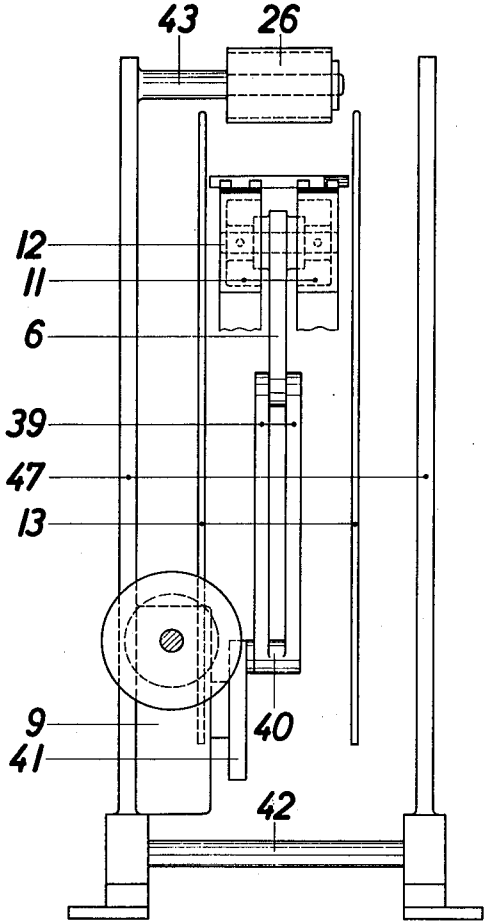
FIG. 3 is a schematic and view, looking downstream of the conveyor, of the apparatus of FIG. 1.
Figure 2:
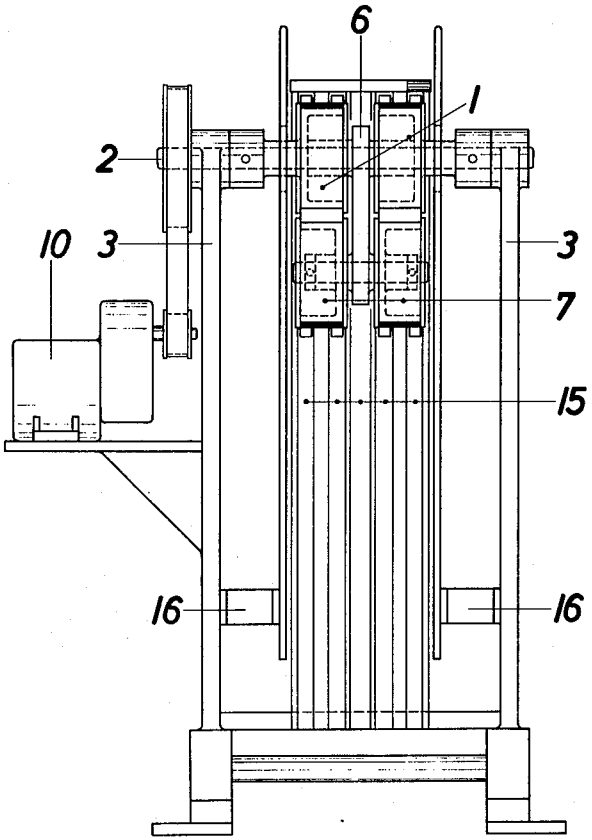
FIG. 2 is a schematic and view, looking upstream of the conveyor, of the apparatus of FIG. 1.

As is shown in FIGS. 4 and 5, the carrier member 6 can be provided with a central extension 54, as well as with two lateral extensions 53 on each side of and adjacent to the divided belt 4, the extension 54 extending into a corresponding recess in the wall 14 and the extensions 53 laterally partially encompassing the wall 14. By this means, cigarettes are prevented from entering the space S, so as to avoid any damage to the cigarettes in the store when the carrier member 6 is pivoted upwardly. The guide element 60 is also provided with a recess to receive the extension 54.

I claim:

1. Conveying and storing apparatus for conveying articles between two machines and for storing articles in transit between the machines, comprising a conveyor to convey the articles in a conveying direction, the conveyor comprising a pivotable carrier member, two pulleys each of divided construction mounted on said carrier member respectively upstream and downstream in said conveying direction and rotatable about respective axes of rotation, a conveyor belt of divided construction extending around said pulleys, a plurality of article entraining elements each of divided construction and provided on said conveyor belt, said carrier member being pivotable about the axis of rotation of the downstream one of said pulleys and being disposed between divided portions of said pulleys, and store defining means to define with said conveyor a store for storing said articles, said store defining means comprising an arcuate wall element provided with a plurality of recesses receiving the divided portions of said entraining elements, said arcuate wall element being arranged adjacent to said conveyor belt at the upstream and of said conveyor and extending parallel to the path described by said upstream end of said conveyor under pivoting of said carrier member.

2. Apparatus according to claim 1, wherein the conveyor further comprises a tensioning pulley mounted on said carrier member to tension said conveyor belt.

3. Apparatus according to claim 1, wherein said carrier member is pivotable between a first setting in which the conveyor is horizontal, a second setting in which said upstream one of the pulleys is at a lower level than said downstream one of the pulleys, and a further setting intermediate said first and second settings.

4. Apparatus according to claim 1, comprising a guide element arranged above the upstream one of said pulleys to guide articles onto said conveyor belt.

5. Apparatus according to claim 1, comprising a first drive means to drive said conveyor belt, a second drive means to pivot said carrier member, and control means to control said first and second drive means in dependence on the operating states of a machine supplying the articles to the apparatus and a machine receiving the articles from the apparatus.

6. Apparatus according to claim 1, wherein said store defining means comprises side wall elements arranged on both sides of the conveyor and so extending above said conveyor belt as to define a channel with said conveyor belt.

7. Apparatus according to claim 1, wherein said carrier member is provided adjacent the upstream one of said pulleys with at least one projection, which extends in a plane at a spacing above a plane containing the axes of rotation of said pulleys and which is co-operable with said arcuate wall element to prevent articles lying between said conveyor belt and said arcuate wall element from entering the space between the planes.

8. Apparatus according to claim 1, comprising a plurality of such conveyors arranged one after the other and a corresponding plurality of such store defining means respectively associated with the conveyors.

* * * * *